US008714122B2

(12) United States Patent
Yamazaki et al.

(10) Patent No.: US 8,714,122 B2
(45) Date of Patent: May 6, 2014

(54) TWO-STROKE ENGINE HAVING A PORTED PISTON TO FACILITATE AIRFLOW THERETHROUGH

(75) Inventors: Takahiro Yamazaki, Tokyo (JP); Koichirou Ogura, Tokyo (JP); Hisato Onodera, Tokyo (JP); Yusuke Suzuki, Tokyo (JP)

(73) Assignee: Yamabiko Corporation, Tokyo (JP)

( * ) Notice: Subject to any disclaimer, the term of this patent is extended or adjusted under 35 U.S.C. 154(b) by 448 days.

(21) Appl. No.: 12/898,489

(22) Filed: Oct. 5, 2010

(65) Prior Publication Data

US 2011/0079206 A1 Apr. 7, 2011

(30) Foreign Application Priority Data

Oct. 7, 2009 (JP) ..... 2009-233209

(51) Int. Cl.
*F02B 33/04* (2006.01)

(52) U.S. Cl.
USPC ..... 123/73 AA; 123/73 PP; 92/181 R; 92/181 P

(58) Field of Classification Search
USPC ..... 123/73 A, 73 AA, 73 PP, 73 R; 92/172, 92/181 R, 181 P
See application file for complete search history.

(56) References Cited

U.S. PATENT DOCUMENTS 4,469,054 A * 9/1984 Onishi et al. ..... 123/73 R
5,628,295 A * 5/1997 Todero et al. ..... 123/568.13
6,289,856 B1 9/2001 Noguchi
6,497,204 B1 * 12/2002 Miyazaki et al. ..... 123/73 PP
6,564,760 B2 * 5/2003 Laydera-Collins ..... 123/73 AA
6,662,765 B2 * 12/2003 Araki ..... 123/73 A
6,932,032 B2 * 8/2005 Lingen et al. ..... 123/73 A
7,025,021 B1 * 4/2006 Andersson et al. ..... 123/73 PP
7,255,072 B2 * 8/2007 Yamaguchi ..... 123/73 AA
8,065,981 B2 * 11/2011 Ishida ..... 123/73 AA
2003/0075124 A1 * 4/2003 Haman ..... 123/73 PP
2003/0200941 A1 10/2003 Schlossarczyk et al.
2004/0144343 A1 7/2004 Osburg et al.
2005/0098124 A1 5/2005 Lingen et al.
2006/0278183 A1 * 12/2006 Mavinahally et al. ..... 123/73 V
2008/0302344 A1 12/2008 Kunert et al.

FOREIGN PATENT DOCUMENTS

WO 98/57053 12/1998
WO 00/65209 11/2000

OTHER PUBLICATIONS

The extended European Search Report dated Sep. 17, 2012; EP Application No./Patent No. 10186872.7-1263 / 2309107.

* cited by examiner

*Primary Examiner* — Noah Kamen
*Assistant Examiner* — Grant Moubry
(74) *Attorney, Agent, or Firm* — Studebaker & Brackett PC

(57) ABSTRACT

In a two-stroke engine (1) according to the present invention, a piston (6) has a communication passage (28) opened to a crank chamber (10). An air intake port (30) is provided on an inner surface (2*a*) for causing air to flow into the communication passage (28). After a scavenging port (22) is closed by an outer surface (6*a*) of the piston (6) moving from the bottom dead center to the top dead center, the communication passage (28) is opened in the outer surface (6*a*) of the piston so as to communicate with the air intake port (30) and the scavenging port (22).

6 Claims, 6 Drawing Sheets

TWO-STROKE ENGINE HAVING A PORTED PISTON TO FACILITATE AIRFLOW THERETHROUGH

TECHNICAL FIELD

The present invention relates to a two-stroke engine.

PRIOR ART

Conventionally, a two-stroke gasoline engine has been used as a power source for a portable handheld-work machine such as a bush cutter and a chain saw. In this type of two-stroke engine, a scavenging process of a cylinder chamber is performed by using an air-fuel mixture previously compressed in a crank chamber. Specifically, an up-stroke of a piston allows the air-fuel mixture to be drawn via an intake port into the crank chamber below the piston, and a down-stroke of the piston allows the air-fuel mixture to be compressed, and then the compressed air-fuel mixture is emitted into the cylinder chamber above the piston so that the combustion gas can be exhausted.

In the scavenging process in this two-stroke engine, when air-fuel (air-gasoline) mixture (fresh air-fuel mixture) is fed from the crank chamber through the scavenging passage into the cylinder chamber to scavenge the combustion gas, a phenomenon in which the fresh air-fuel mixture is exhausted with the combustion gas or directly blown out (a blow-by phenomenon) tends to occur. If the blow-by phenomenon occurs, unburned combustion fuel (gasoline) included in the fresh air-fuel mixture would be released into the atmosphere, a fuel consuming rate would increase, and an atmospheric contamination problem would be caused.

In order to prevent the blow-by phenomenon or reduce it, a stratified scavenging type two-stroke engine has been known (for example, described in the Patent Publications 1 and 2 listed below). In the stratified scavenging type two-stroke engine, before an exhaust process, a scavenging passage is filled with air, and in an initial stage of the scavenging process, the combustion gas is scavenged by the air, so that the fresh air-fuel mixture which was exhausted with the combustion gas is replaced with air to prevent the unburned fuel from being released into the atmosphere or to reduce it.

Patent Publication 1: International Publication No. WO 98/57053

Patent Publication 2: International Publication No. WO 00/65209

SUMMARY OF THE INVENTION

However, in the stratified scavenging type two-stroke engine, air may remain locally in the combustion chamber to interfere with the ignition so that combustion efficiency (output) may be reduced in comparison with that of a two-stroke engine in which the combustion gas is scavenged only by an air-fuel mixture.

Further, since the purpose of the stratified scavenging type two-stroke engine is to achieve the scavenging process by supplying a sufficient amount of air into the cylinder, it is required that a density of the air-fuel mixture suctioned via the air-fuel mixture intake port be higher than that in a normal two-stroke engine. As a result, in the stratified scavenging type two-stroke engine, it is difficult to set optimal operation conditions because adjustment of the carburetor becomes difficult and sensitive. Specifically, the carburetor is sensitive to: climate conditions such as atmosphere temperature and pressure, load change of the work machine (in the case where the work machine provided with the two-stroke engine is a bush cutter, loads are hardness and amount of grass), and a pre-conditioning period of the work machine (whether the pre-conditioning period is very short or sufficiently long after a start of the work machine). Especially in a work machine such as a bush cutter or a chain saw, an output of the engine thereof is required to be maximized under a broad range of circumstances, for example, climate conditions, load changes, other circumstantial factors, and a combination thereof.

Further, in the stratified scavenging type two-stroke engine in which an air intake port communicates with a scavenging port by using a communication passage provided in the piston, since the communication passage is configured to communicate with neither the cylinder chamber nor the crank chamber over the piston stroke, the length of the piston becomes long so that a size of the engine becomes large, which is also a problem of this type of two-stroke engine.

Further, in the stratified scavenging type two-stroke engine, it is required that emissions of the unburned fuel be reduced more than in the case of the normal two-stroke engine in which the scavenging is achieved by only air-fuel mixture.

Thus, the object of the present invention is to provide a new scavenging type two-stroke engine which prevents a size of the engine from becoming large, restricts emission of unburned fuel, and maximizes an output of the engine under a broad variety of circumstances.

To achieve the above-state purpose, a two-stroke engine according to the present invention comprising: a cylinder having an inner surface defining a bore; a piston reciprocating in the bore of the cylinder; a cylinder chamber partitioned by the inner surface of the cylinder and the piston; a crank chamber located under the piston; an air-fuel mixture intake port causing air-fuel mixture to flow into the crank chamber; a scavenging port provided in the inner surface of the cylinder for causing the air-fuel mixture in the crank chamber to flow into the cylinder chamber through a scavenging passage; an exhaust port provided in the inner surface of the cylinder for exhausting combustion gas in the cylinder chamber; the piston having a communication passage opening to the crank chamber; and an air intake port provided in the inner surface of the cylinder for causing air to flow into the communication passage; wherein the communication passage opens on the outer surface of the piston so that after an outer surface of the piston moving from the bottom dead center toward the top dead center closes the scavenging port so as not to communicate with the cylinder chamber, the communication passage communicates with the air intake port and the scavenging port, whereby the air flowing via the air intake port into the communication passage and the original air-fuel mixture in the communication passage together forms a diluted air-fuel mixture which is more diluted than the original air-fuel mixture, and the diluted air-fuel mixture flows via the scavenging port into the scavenging passage, and wherein when the outer surface of the piston moving from the top dead center toward the bottom dead center causes the exhaust port and the scavenging port to open to the cylinder chamber, the combustion gas is exhausted by means of the diluted air-fuel mixture.

In this two-stroke engine, while the piston moves from the bottom dead center to the top dead center and after the outer surface of the piston closes the scavenging port so as not to communicate with the cylinder chamber, the communication passage opening to the crank chamber communicates with the air intake port and the scavenging port. This allows air flowing via the air intake port into the communication passage and the original air-fuel mixture in the communication passage to together form a diluted air-fuel mixture which is more diluted than the original air-fuel mixture, and this diluted air-fuel mixture flows via the scavenging port into the scavenging passage. Then, while the piston moves from the top dead center to the bottom dead center and when the piston opens the exhaust port and the scavenging port so as to communicate with the cylinder chamber, the diluted air-fuel mixture in the scavenging passage initially flows into the cylinder chamber, and the combustion gas is scavenged by means of the diluted air-fuel mixture.

Even if the diluted air-fuel mixture directly blows out via the exhaust port, emission of the unburned fuel can be restricted more than that of the unburned fuel exhausted from a normal (conventional) two-stroke engine in which the scavenging process is performed only by the original (non-diluted) air-fuel mixture, because the diluted air-fuel mixture is more diluted than the original air-fuel mixture.

Further, even if the diluted air-fuel mixture locally remains in the cylinder chamber (hence, in the combustion chamber), the air-fuel mixture in the combustion chamber is surely ignited so that a combustion process is performed, because the diluted air-fuel mixture including fuel does not interfere with the ignition, unlike a case in which a air layer not including fuel locally remains in the combustion chamber.

Further, since air suctioned via the air intake port and the air-fuel mixture are mixed with each other and supplied into the cylinder chamber as the diluted air-fuel mixture, a concentration of the air-fuel mixture suctioned via the air-fuel mixture intake port is not required to be very high so that an adjustment of a carburetor can be stably performed regardless of fluctuations of environmental factors and so on.

Further, since the communication passage of the piston opens to the crank chamber, a piston length can be shorter than that in a stratified scavenging type two-stroke engine so that the size of the engine can be prevented from becoming larger.

In an embodiment of the present invention, the communication passage preferably opens on the outer surface of the piston so that the communication passage communicates with the air intake and the scavenging port for a certain period after the outer surface of the piston moving from the bottom dead center toward the top dead center closes the scavenging port so as not to communicate with the cylinder chamber and before the air-fuel mixture intake port opens to the crank chamber.

Further, in an embodiment of the present invention, the communication passage preferably continues to communicate with the scavenging port for at least a period from the start to the end of the communication between the communication passage and the air intake port through the outer surface of the piston.

In this embodiment, the diluted air-fuel mixture formed by the air flowing via the air intake port into the communication passage and the original air-fuel mixture in the communication passage can be effectively flowed via the scavenging port into the scavenging passage so that a sufficient amount of diluted air-fuel mixture can be introduced into the scavenging passage.

Further, in an embodiment in the present invention, the communication passage may be formed in the interior of the piston and it has a first port opening to the scavenging port and a second port opening to the air intake port, or it may be a groove formed on the outer surface of the piston.

Further, in an embodiment of the present invention, preferably, the air-fuel mixture intake port is provided on the inner surface of the cylinder and is opened for communication with and closed so as not to communicate with the crank chamber by the outer surface of the piston.

In this embodiment, a structure of the above-stated scavenging type two-stroke engine can be simplified.

As explained above, the new scavenging type two-stroke engine according to the present invention restricts the size of the engine from becoming larger, restricts emission of unburned fuel more than that of unburned fuel exhausted from the normal two-stroke engine in which the combustion gas is scavenged only by air-fuel mixture, and maximizes an output of the engine under a variety of environments.

DESCRIPTION OF THE PREFERRED EMBODIMENTS

Figure 1:
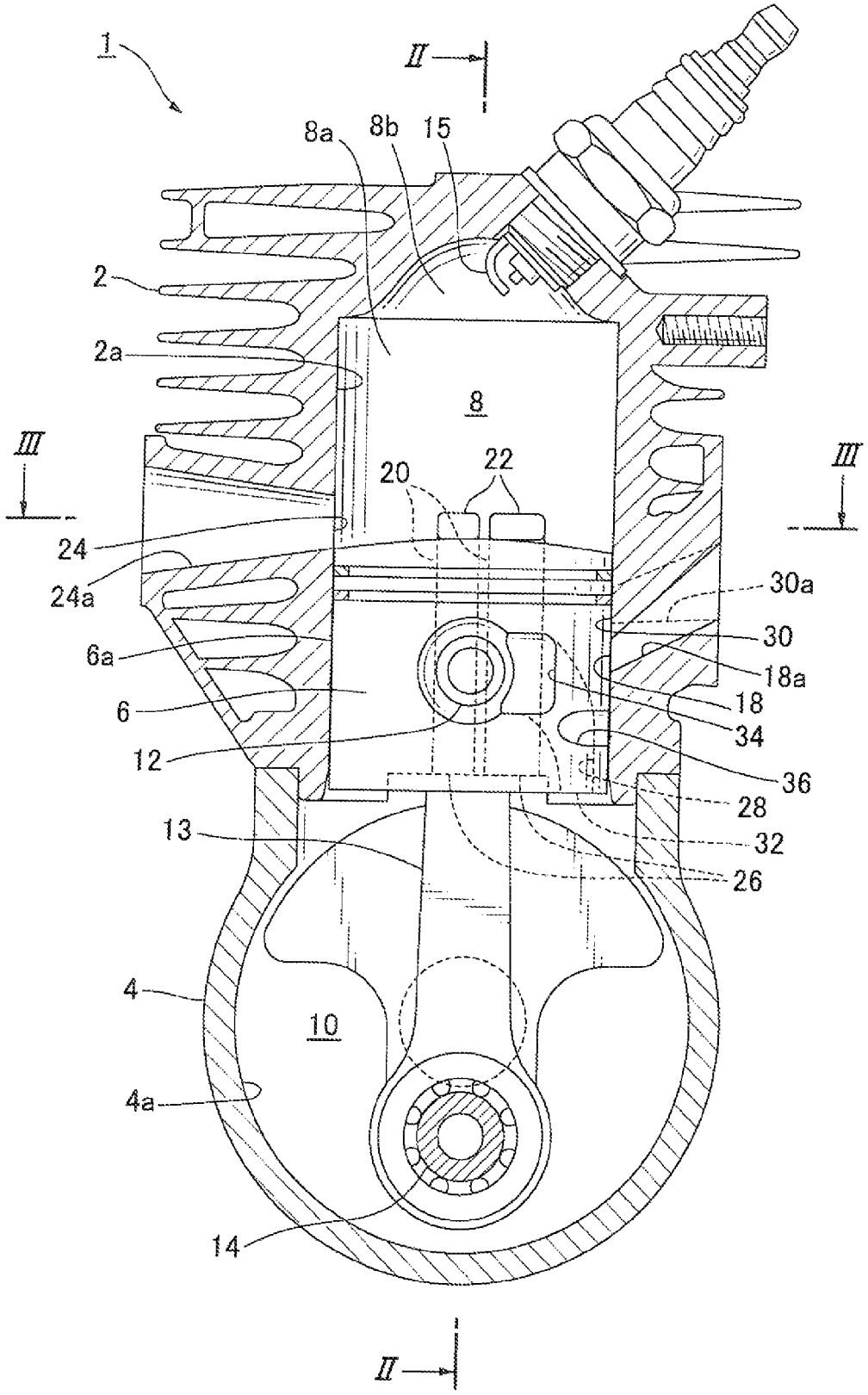
FIG. 1 is a cross-sectional view of a two-stroke engine according to the present invention when a piston is located at the bottom dead center.
Figure 2:
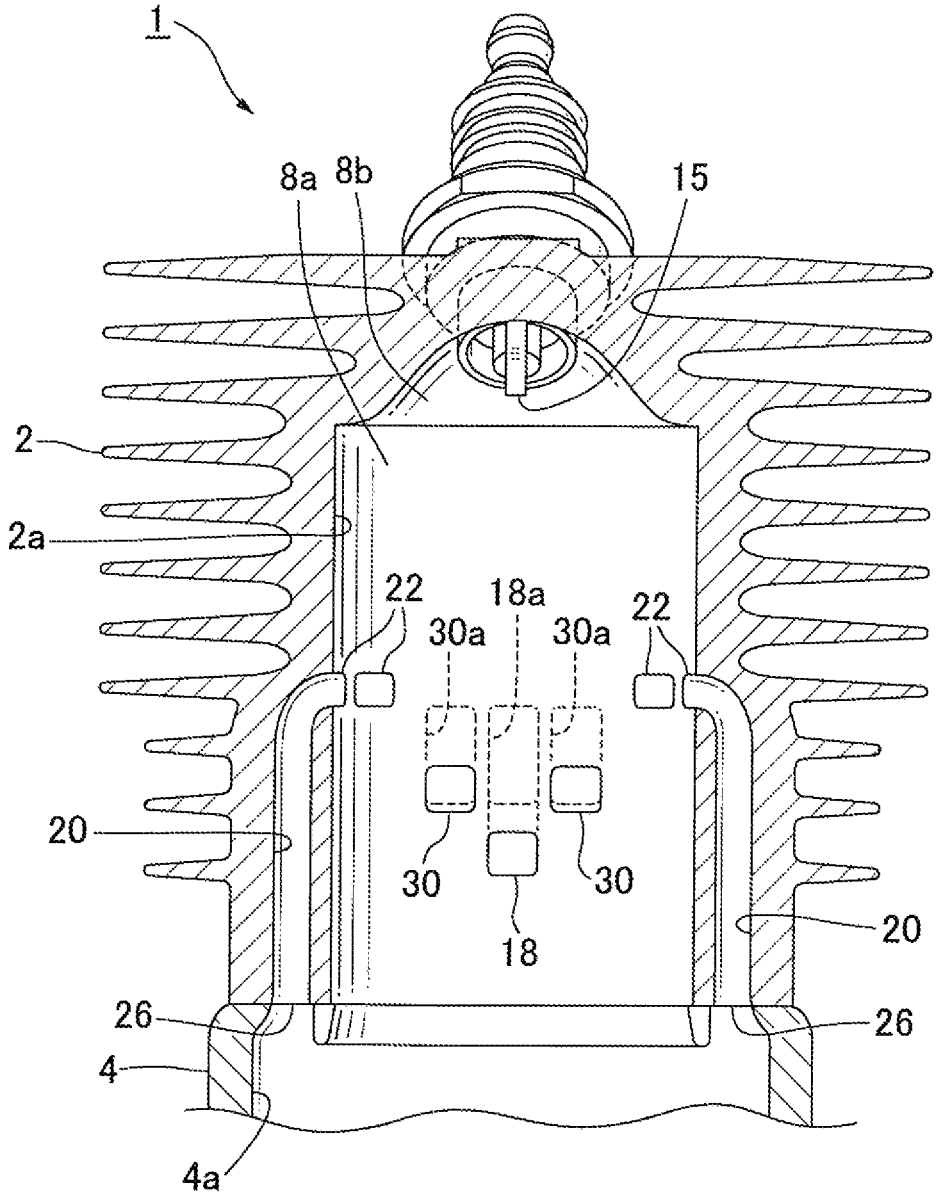
FIG. 2 is a cross-sectional view taken along a line II-II in FIG. 1, but omitting the piston.
Figure 3:
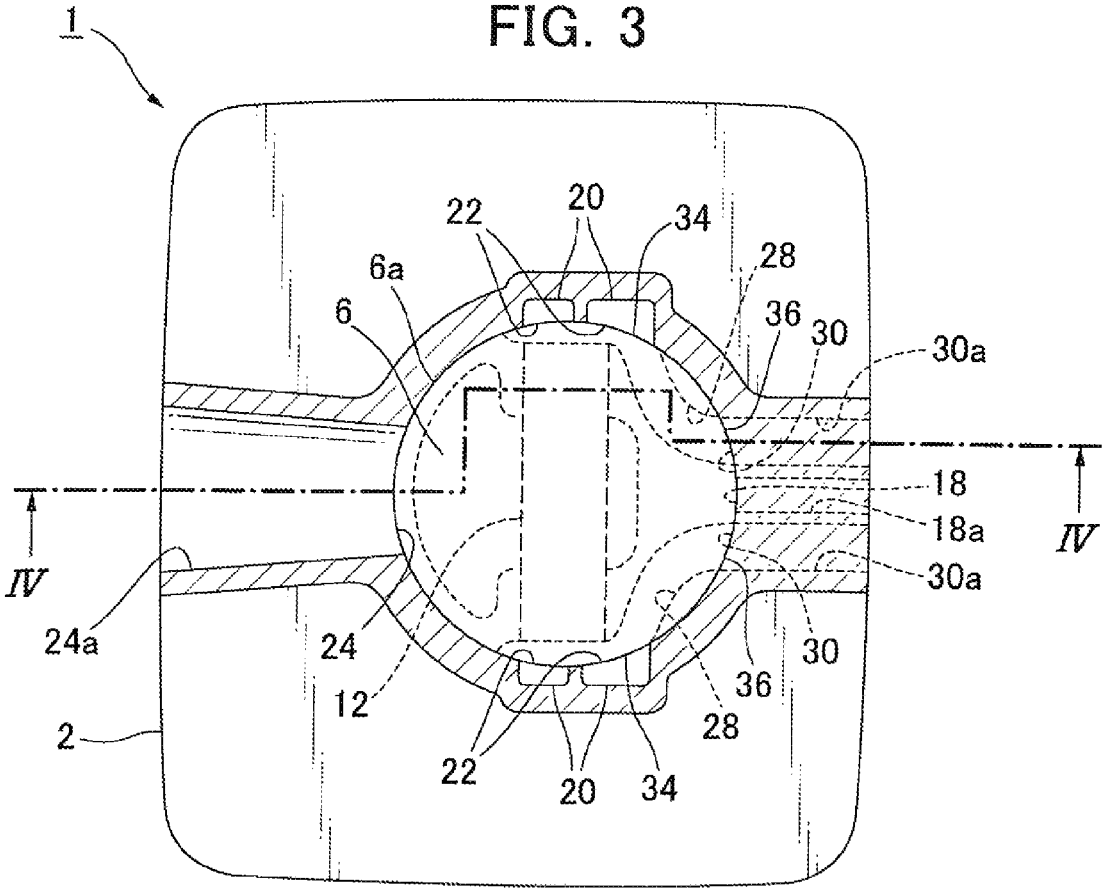
FIG. 3 is a cross-sectional view taken along a line III-III in FIG. 1.

Now, referring to the drawings, an embodiment of a two-stroke engine according to the present invention will be explained. FIG. 1 is a cross-sectional view of a two-stroke engine according to the present invention when a piston is located at the bottom dead center. FIG. 2 is a cross-sectional view taken along a line II-II shown in FIG. 1, but the piston is omitted. FIG. 3 is a cross-sectional view taken along a line III-III shown in FIG. 1.

As shown in FIG. 1, a two-stroke engine 1, which is an embodiment of the present invention, is a gasoline engine and includes a cylinder having an inner surface 2*a* defining a bore 8*a*, a crank case 4 having an inner surface 4*a* and connected to the cylinder 2, and a piston 6 reciprocating in the bore 8*a* of the cylinder 2.

Further, the two-stroke engine 1 includes a cylinder chamber 8 partitioned by the inner surface 2*a* of the cylinder 2 and the piston 6, and a crank chamber 10 partitioned by the inner surface 4*a* of the crank case 4 and the piston 6. The crank chamber 10 is located under the piston 6. The piston 6 is connected to a crank shaft 14 via a pin 12 and a connecting rod 13, and reciprocates between the top dead center (see FIG. 6) and the bottom dead center (see FIG. 1). When the piston 6 reciprocates, one of the volumes of the cylinder chamber 8 and the crank chamber 10 increases while the other decreases.

The inner surface 2*a* of the cylinder 2 also forms a combustion chamber 8*b* above the bore 8*a*, and an ignition plug 15 is displaced in the combustion chamber 8*b*.

As shown in FIGS. 1-3, the two-stroke engine 1 includes an air-fuel mixture intake port 18 for causing an air-fuel mixture to flow into the crank chamber 10; scavenging ports 22 provided in the inner surface 2*a* of the cylinder 2 for causing the air-fuel mixture in the crank chamber 10 to flow into the cylinder chamber 8 through respective scavenging passages 20; and an exhaust port 24 provided in the inner surface 2*a* of the cylinder for exhausting combustion gas in the cylinder chamber 8.

An air-fuel mixture passage 18*a* extends from the air-fuel mixture intake port 18 toward a carburetor (not shown). In the present embodiment, the air-fuel mixture intake port 18 is provided in the inner surface of the cylinder 2, and is opened for communication with and closed so as not to communicate with the crank chamber 10 by an outer surface 6*a* of the piston 6. The air-fuel mixture intake port 18 is opened to the cylinder chamber 8 at least when the piston 6 is located at the top dead center (see FIG. 6).

An exhaust passage 24*a* extends from the exhaust port 24 toward an exhaust opening (not shown). The exhaust port 24 is opened for communication with and closed so as not to communicate with the cylinder chamber 8 by the outer surface 6*a* of the piston 6. The exhaust port 24 is opened to the cylinder chamber 8 at least when the piston 6 is located at the bottom dead center (see FIG. 1). As shown in FIG. 3, the exhaust port 24 is located at a position offset from the air-fuel mixture intake port 18 by 180 degrees.

As shown in FIG. 3, two of the scavenging ports 22 are provided so as to be offset in one direction from the air-fuel mixture intake port 18 by about 90 degrees, while two other scavenging ports are provided so as to be offset in the opposite direction therefrom by about 90 degrees. The scavenging passages 20 extend from the respective scavenging ports 22 through the interior of the cylinder 2, and terminate at respective ports 26 opening to the crank chamber 10. The scavenging ports 22 are opened for communication with and closed so as not to communicate with the cylinder chamber 8 by the outer surface 6*a* of the piston 6. The scavenging ports 22 are opened to the cylinder chamber 8 at least when the piston 6 is located at the bottom dead center 6 (FIG. 1).

In the present embodiment, the exhaust port 24 and the scavenging ports 22 each have a generally rectangular shape, and the levels of respective upper end surfaces of these ports 22, 24 are substantially the same as each other. Further, the air-fuel mixture intake port 18 is located below the exhaust port 24 and the scavenging ports 22.

Further, the two-stroke engine 1 includes air intake ports 30 provided in the inner surface 2*a* of the cylinder 2 for causing air to flow into respective communication passages 28 (explained in detail later) of the piston 28. As shown in FIG. 3, one of the air intake ports 30 is provided on one side of the air-fuel mixture intake port 18 and the other air intake port 18 is provided on the other side thereof. Air passages 30*a* extend from the respective air intake ports 30 toward an air supplier (not shown). The air intake ports 30 are opened for communication with and closed so as not to communicate with the communication passages 28 by the outer surface 6*a* of the piston 6. The air intake ports 30 are located above the air-fuel mixture intake port 18 and below the exhaust port 24 and the scavenging ports 22.

The pin 12 pivotally connected to the piston 6 extends perpendicular to a line connecting the exhaust port 24 with the air-fuel mixture intake port 18. The piston 6 has the above-stated communication passages 28 provided with respective openings 32 opened to the crank chamber 10. There are two communication passages 28 in accordance with the number of the air intake ports 30. Each of the communication passages 28 is opened in the outer surface 6*a* of the piston 6 so as to be communicated with the air intake ports 30 and the respective scavenging ports 22. In the present embodiment, the communication passages 28 are formed through the interior of the piston 6 and have respective first ports 34 opened to the respective scavenging ports 22 and respective second ports 36 opened to the respective air intake ports 30.

The communication passages 28 are configured so that air flows via the air intake ports 30 and the second ports 36 through the communication passages 28 and is directed to the first ports 34 and the scavenging ports 22. The first ports 34 are recessed from the outer surface 6*a* of the piston 6 at locations where the first ports 34 overlap the pin 12 so that the first ports 34 communicate with the two scavenging ports 22.

The first ports 34 are located above the second ports 36. Preferably, vertical lengths of the second ports 36 when they are opened are substantially the same as those of the air intake ports 30. When the second ports 36 and the air intake ports 30 are aligned with each other, the first ports 34 are aligned with the scavenging port 22. Further, vertical lengths of the first ports 34 when they are opened are larger than those of the second ports 36. The vertical lengths of the first ports 34 are preferably determined so that the first ports 34 of the communication passages 28 and the scavenging ports 22 continue to communicate with each other at least for a period from the start to the end of the communication between the air intake ports 30 and the second ports 36 of the communication passage 28 while the piston 6 moves from the bottom dead center to the top dead center.

Next, an operation of the two-stroke engine according to the present invention will be explained.

When the piston 6 is located at the bottom dead center as shown in FIG. 1, combustion gas is exhausted via the exhaust port 24 and is scavenged by the air-fuel mixture, as will be explained later, and the cylinder chamber 8 is filled with the air-fuel mixture. Then, when the piston 6 is lifted from the bottom dead center, the exhaust port 24 and the scavenging ports 22 provided in the inner surface 2*a* of the cylinder 2 are closed by the outer surface 6*a* of the piston 6 so as not to communicate with the cylinder chamber 8. Further, the air-fuel mixture intake port 18 and the air intake ports 30 provided in the inner surface 2*a* of the cylinder 2 are also closed by the outer surface 6*a* of the piston 6 so as not to communicate with the crank chamber 10. Thus the lifting of the piston 6 allows internal pressures of the crank chamber 10, the scavenging passages 20 and the communication passages 28 to be reduced. Further, in the cylinder chamber 8, a compressing process for compressing the air-fuel mixture starts.

Figure 4:
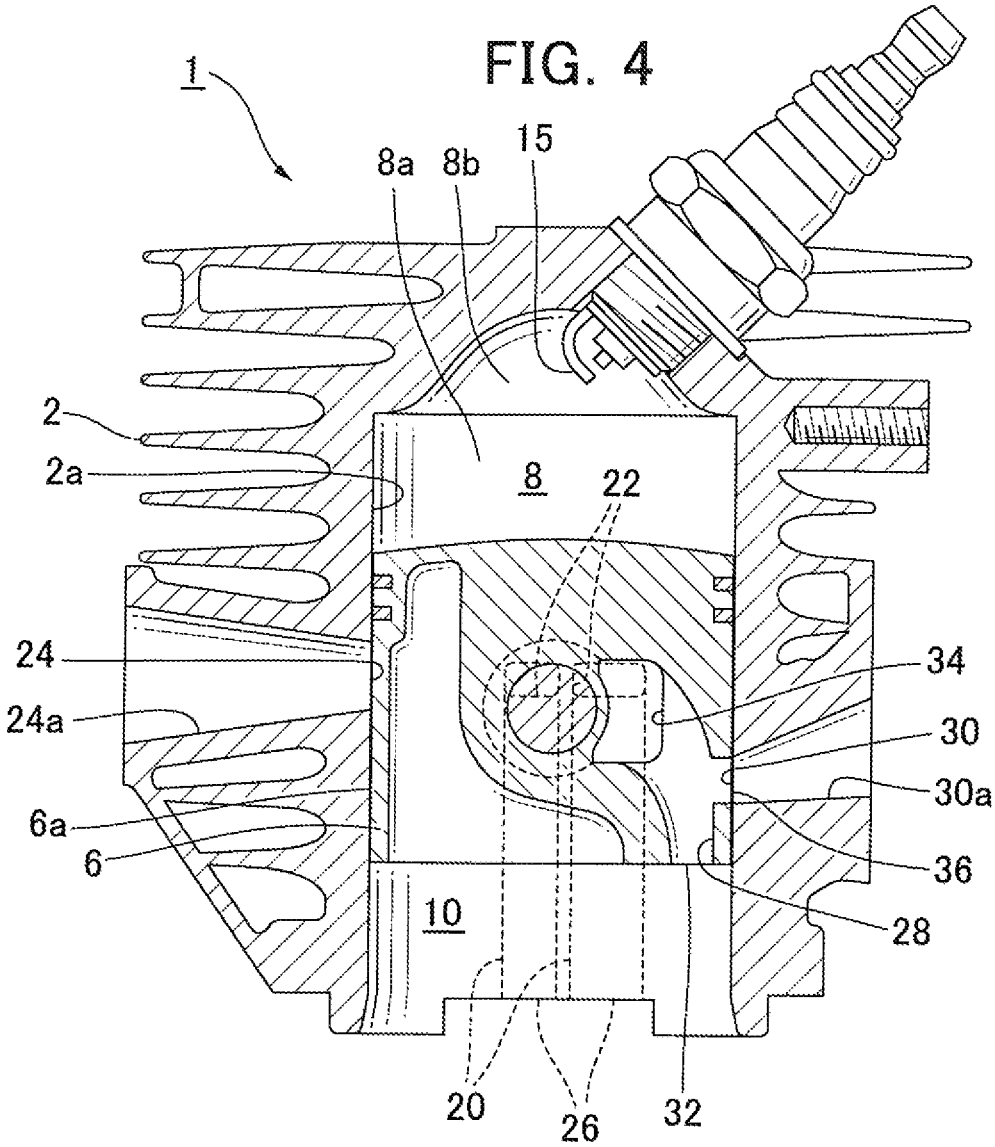
FIG. 4 is a cross-sectional view taken along a line IV-IV in FIG. 3 when the piston is located at a position higher than that shown in FIG. 1.

After the above, while the piston 6 is being lifted to a position shown in FIG. 4, the air intake ports 30 provided in the inner surface 2*a* of the cylinder 2 and the second ports 36 of the communication passages provided in the outer surface 6*a* of the piston 6 gradually overlap each other to communicate the air intake ports 30 with the second ports 36. Since the internal pressure of the communication passages 28 is reduced, air flows via the air intake ports 30 into the communication passages 28 so that the air flowing into the communication passages 28 and the original air-fuel mixture in the communication passages 28 are mixed with each other to dilute the original air-fuel mixture in the communication passage 28 (the air-fuel mixture being diluted will be referred to as "diluted air-fuel mixture", while the original air-fuel mixture is referred to as "normal air-fuel mixture", hereinafter), so that the diluted air-fuel mixture which is more diluted than the normal air-fuel mixture is formed. Further, at the same time that the air intake ports 30 overlap the second ports 36, the scavenging ports 22 provided in the inner surface 2*a* of the cylinder 2 and the first ports 34 of the communication passages 28 provided in the outer surface 6*a* of the piston 6 gradually overlap each other so that the scavenging ports 22 communicate with the first ports 34. Thus the diluted air-fuel mixture flows from the communication passages 28 via the scavenging ports 22 into the scavenging passages 20. It should be noted that the exhaust port 24 provided in the inner surface 2*a* of the cylinder 2 and the air-fuel mixture intake port 18 are kept closed by the outer surface 6*a* of the piston 6.

Figure 5:
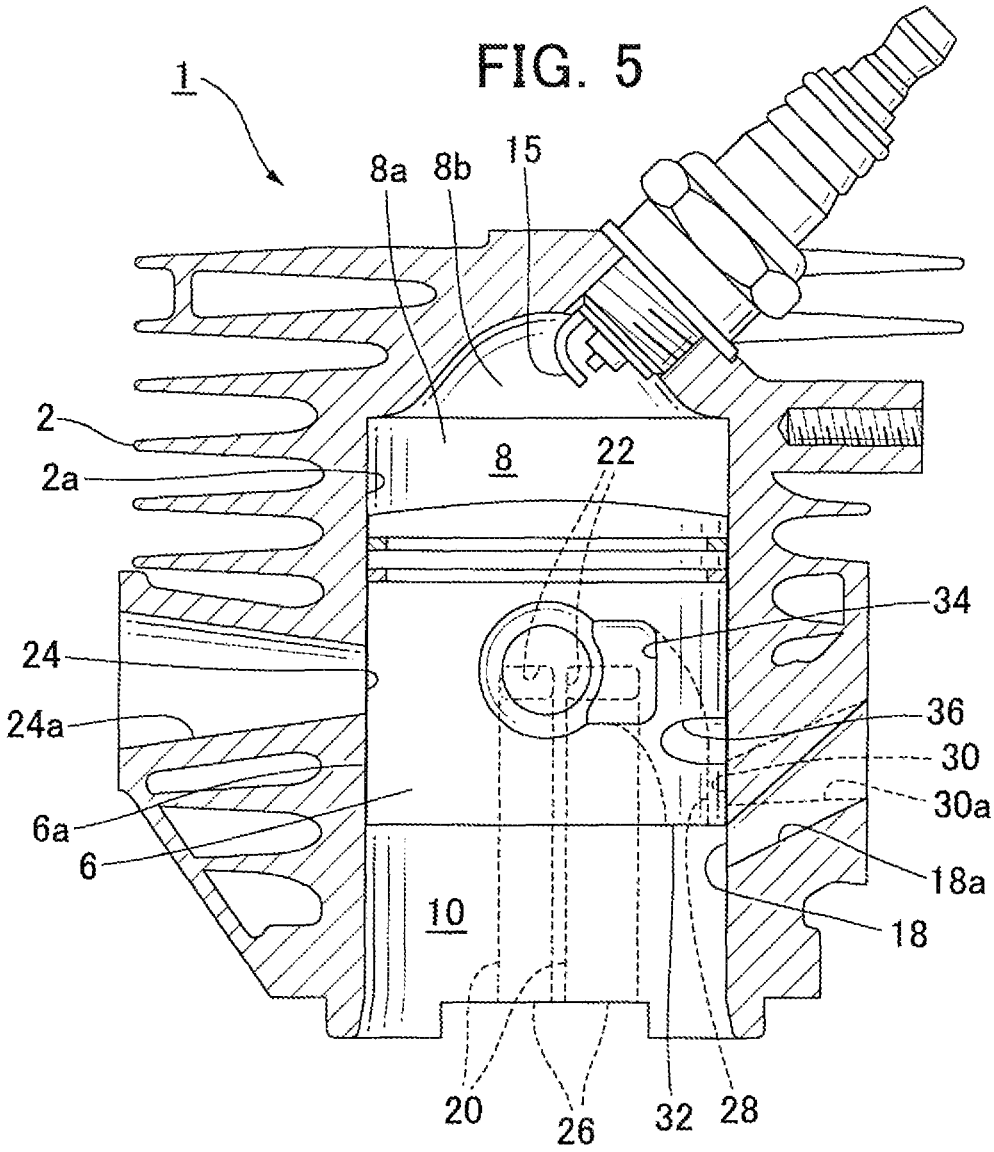
FIG. 5 is a cross-sectional view similar to FIG. 1 when the piston is located at a position higher than that shown in FIG. 4.

Next, when the piston 6 is lifted to a position shown in FIG. 5, the air intake ports 30 provided in the inner surface 2*a* of the cylinder 2 are closed by the outer surface 6*a* of the piston 6 so as not to communicate with the second ports 36 of the communication passages 28. After this, the scavenging ports 22 are closed by the outer surface 6*a* of the piston 6 so as not to communicate with the first ports 34. At this point, the diluted air-fuel mixture lies in upper portions of the scavenging passages 20.

Thus the communication passages 28 continue to communicate with the scavenging ports 22 at least from the start to the end of the communication between the air intake ports 30 and the second ports 36 due to the outer surface 6*a* of the piston 6 moving from the bottom dead center to the top dead center.

Further, at a position shown in FIG. 5, the air-fuel mixture intake port 18 provided in the inner surface 2*a* of the cylinder 2 is opened by the outer surface 6*a* of the piston 6 so as to communicate with the crank chamber 10. Thus an intake process of air-fuel mixture starts, namely, the air-fuel mixture flows into the crank chamber 10.

Further, during a certain period in which the piston 6 moves from the bottom dead center to the top dead center, the exhaust port 24 and the scavenging ports 22 are closed by the outer surface 6*a* of the piston 6 so as not to communicate with the crank chamber 10, and the air-fuel mixture intake port 18 is opened to the crank chamber 10 so that the air-fuel mixture is suctioned via the air-fuel mixture intake port 18 into the crank chamber 10.

Figure 6:
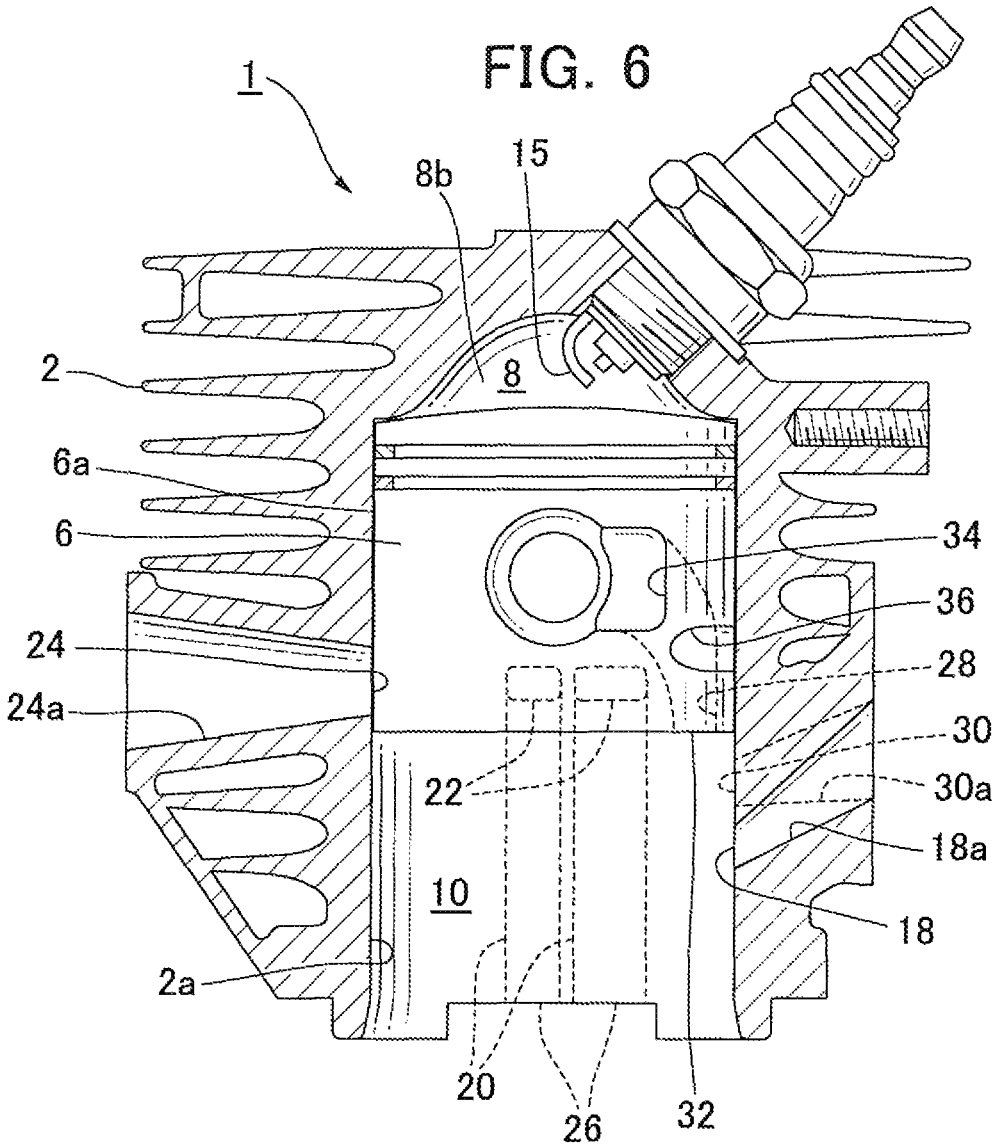
FIG. 6 is a cross-sectional view similar to FIG. 1 when the piston is located at the top dead center.

When the piston 6 is lifted to the top dead center shown in FIG. 6, the compressing process in the cylinder chamber 8 and the intake process of the air-fuel mixture in the crank chamber 10 terminate. The air-fuel mixture in the combustion chamber 8*b* is ignited by the ignition plug 15, the air-fuel mixture combusts and the combustion gas is expanded. It should be noted that, as shown in FIG. 6, although the air intake ports 30 are opened to the crank chamber 10, air does not flow into the crank chamber 10 because the air-fuel mixture intake process is over; namely, the pressure in the crank chamber 10 is increased. With this arrangement the size of the two-stroke engine 1 can be reduced.

While the piston 6 is being lowered to the bottom dead center shown in FIG. 1, the exhaust port 24 is gradually opened so as to communicate with the cylinder chamber 8 and an exhaust process starts. The combustion gas (exhaust gas) is exhausted via the exhaust port 24. Further, the air intake ports 30 and the air-fuel mixture intake port 18 are closed by the outer surface 6*a* of the piston 6 so as not to communicate with the crank chamber 10 and the pressure in the crank chamber 10 is increased. Then the scavenging ports 22 are opened by the outer surface 6*a* of the piston 6 so as to communicate with the cylinder chamber 8. Thus the scavenging process starts.

Since the diluted air-fuel mixture is at least in the upper portions of the scavenging passage 20, when the scavenging ports 22 are opened to the cylinder chamber 8, firstly the diluted air-fuel mixture flows into the cylinder chamber 8 and then the normal air-fuel mixture flows into the cylinder chamber 8.

Even if the diluted air-fuel mixture is directly blown out from the exhaust port 24, since the diluted air-fuel mixture is more diluted than the normal air-fuel mixture, emission of the unburned fuel (fuel) can be reduced in comparison with a case in which the normal air-fuel mixture is directly blown out from the exhaust port 24.

Further, even if the diluted air-fuel mixture remains locally in the cylinder chamber 8, hence in the combustion chamber 8*b*, ignition of the air-fuel mixture in the combustion chamber 8*b* is ensured and combustion is performed, because the diluted air-fuel mixture including fuel does not interfere with the ignition, unlike a case in which an air layer not including fuel remains locally in the combustion chamber 8*b*.

Comparing the present invention with a stratified scavenging type two-stroke engine, in the stratified scavenging type two-stroke engine, since it is considered to be a primary object that the unburned fuel not be exhausted, an air layer introduced into the cylinder chamber 8 in the scavenging process may locally remain in the combustion chamber 8*b* to interfere the ignition process. Further, in the stratified scavenging type two-stroke engine, since it is an object that the scavenging process is achieved by supplying a sufficient amount of air into the cylinder chamber 8, a density of the air-fuel mixture suctioned via the air-fuel mixture intake port 18 is required to be high and/or the carburetor becomes sensitive to a change in environment factors and so on, so that adjustment of the carburetor may become difficult.

On the other hand, in the two-stroke engine according to the present invention, as described above, even if the diluted air-fuel mixture is directly blown out, emission of the unburned fuel can be reduced. Further, even if the diluted air-fuel mixture remains locally in the combustion chamber 8*b*, the ignition of the air-fuel mixture in the combustion chamber 8*b* would not be interfered with so that stable output and acceleration performance can be obtained. Further, since a broad proper operational range of the carburetor is assured regardless of fluctuations of environmental factors, an output of the two-stroke engine can be maximized under a broad range of circumstantial conditions.

Further, since the communication passages 28 of the piston 6 are opened to the crank chamber 10, a length of the piston 6 can be made shorter than that of a piston of the stratified scavenging type two-stroke engine having a communication passage in a piston which is not opened to a cylinder chamber and a crank chamber through the full stroke of the piston, so that a size of the engine can be prevented from becoming larger.

An experiment was performed for comparing the two-stroke engine according to the present invention with a two-stroke engine in which combustion gas is scavenged by means of normal air-fuel mixture (referred to as a "conventional two-stroke engine" hereinafter), which engines have the same displacement volume (40.2 cc). As to a total amount of hydrocarbons (g) per horsepower per hour, when a rotational speed is changed from 8,000 rpm to 10,000 rpm under the full throttle condition, in the conventional two-stroke engine, the above amount gradually changes from 45 to 34 g, while in the two-stroke engine according to the present invention, it gradually changes from 34 to 24 g. Thus the two-stroke engine according to the present invention can reduce the total amount of hydrocarbons by about 25% more than the conventional two-stroke engine; namely, the former engine can reduce the amount of unburned fuel.

Further, as to an output power (horsepower), when the rotational speed is changed from 8,000 to 10,000 rpm under the full throttle condition, in the conventional two-stroke engine, the output power gradually changes from 1.7 to 1.9 horsepower, while in the two-stroke engine according to the present invention, it gradually changes from 1.7 to 1.9 horse power. Thus the two-stroke engine according to the present invention has an output power equal to that of the conventional engine.

Further, acceleration tests were performed with respect to bush cutters, one being provided with the two-stroke engine according to the present invention and the other with the stratified scavenging type two-stroke engine. When the rotation speed is rapidly accelerated from 3,000 rpm (idling rotation) to 10,000 rpm (high speed rotation) by grasping the throttle rapidly, in the two-stroke engine according to the present invention, the engine is smoothly accelerated by opening and closing operations of a valve in the carburetor, while in the stratified scavenging type two-stroke engine, the acceleration thereof is sluggish. The reason for this result is considered to be that in the stratified scavenging type two-stroke engine, an air layer remains locally in the combustion chamber to interfere with the ignition process during the rapid change in the rotation speed, or that the combustion becomes unstable due to an insufficient amount of air-fuel mixture or a reduction in a lubricating performance.

Although the preferred embodiment of the present invention has been described, the present invention is not limited to the above-stated embodiment, namely, the embodiment can be modified variously within the scope of the present invention. Thus it is apparent that such modifications fall within the scope of the present invention.

Although a scavenging way of the two-stroke engine according to the present invention is preferably a reverse direction scavenging way, it may be other ways.

Further, although in the above-stated embodiment the communication passages 28 are formed in the interior of the piston 6, the communication passages 28 may each be a recess, such as a groove, formed in the outer surface 6*a* of the piston 6.

Further, although in the above-stated embodiment, the air-fuel mixture intake port 18 is provided in the inner surface 2*a* of the cylinder 2 and is opened for communication with and closed so as not to communicate with the crank chamber 10 by the outer surface 6*a* of the piston 6, it may be provided in the inner surface 4*a* of the crank case 4 and opened for communication with and closed so as not to communicate with the crank chamber 10 by means of a valve (not shown).

Further, in the above-stated embodiment, after the air-fuel mixture intake port 18 is opened to the crank chamber 10, the communication passages 28 still communicate with the air intake ports 30 and the scavenging ports 22. In this connection, if the length of the piston is made longer, the communication passages 28 may be configured to communicate with the air intake ports 30 and the scavenging ports 22 for a certain period before the air-fuel mixture intake port 18 is opened to the crank chamber 10.

What is claimed is:

1. A two-stroke engine comprising:

a cylinder having an inner surface defining a bore;

a piston reciprocating in the bore of the cylinder;

a cylinder chamber partitioned by the inner surface of the cylinder and the piston;

a crank chamber located under the piston;

an air-fuel mixture intake port causing air-fuel mixture to flow into the crank chamber;

a scavenging port provided in the inner surface of the cylinder for causing the air-fuel mixture in the crank chamber to flow into the cylinder chamber through a scavenging passage; and an exhaust port provided in the inner surface of the cylinder for exhausting combustion gas in the cylinder chamber;

the piston having a communication passage, the communication passage having an opening which always and directly opens to the crank chamber, a first port which opens to the scavenging port and a second port which opens to an air intake port provided in the inner surface of the cylinder for causing air to flow into the communication passage, the second port being disposed between the opening and the first port, the communication passage being configured so that air flows from the second port is directed to the first port; and wherein the communication passage opens on the outer surface of the piston so that after the outer surface of the piston moving from the bottom dead center toward the top dead center closes the scavenging port so as not to communicate with the cylinder chamber, the communication passage communicates with the air intake port and the scavenging port, whereby an air flowing via the air intake port into the communication passage and an original air-fuel mixture in the communication passage together form a diluted air-fuel mixture which is more diluted than the original air-fuel mixture, and the diluted air-fuel mixture flows via the scavenging port into the scavenging passage, and wherein when the outer surface of the piston moving from the top dead center toward the bottom dead center causes the exhaust port and the scavenging port to open to the cylinder chamber, the combustion gas is exhausted by means of the diluted air-fuel mixture.

2. The two-stroke engine according to claim 1, wherein the communication passage opens on the outer surface of the piston so that the communication passage communicates with the air intake port and the scavenging port for a certain period after the outer surface of the piston moving from the bottom dead center toward the top dead center closes the scavenging port so as not to communicate with the cylinder chamber and before the air-fuel mixture intake port opens to the crank chamber.

3. The two-stroke engine according to claim 1, wherein the communication passage continues to communicate with the scavenging port for at least a period from the start to the end of the communication between the communication passage and the air intake port through the outer surface of the piston.

4. The two-stroke engine according to claim 1, wherein the communication passage is formed in an interior of the piston.

5. The two-stroke engine according to claim 1, wherein the communication passage is a groove formed on the outer surface of the piston.

6. The two-stroke engine according to claim 1, wherein the air-fuel mixture intake port is provided on the inner surface of the cylinder and is opened for communication with and closed so as not communicate with the crank chamber by the outer surface of the piston.

* * * * *